US007721749B2

(12) United States Patent
Brewin et al.

(10) Patent No.: US 7,721,749 B2
(45) Date of Patent: May 25, 2010

(54) PREFABRICATED SHELTER

(75) Inventors: Peter Brewin, London (GB); William Crawford, London (GB)

(73) Assignee: Crawford Brewin Ltd. (GB)

( * ) Notice: Subject to any disclaimer, the term of this patent is extended or adjusted under 35 U.S.C. 154(b) by 468 days.

(21) Appl. No.: 11/570,811

(22) PCT Filed: Jun. 17, 2005

(86) PCT No.: PCT/GB2005/002406

§ 371 (c)(1),
(2), (4) Date: Apr. 22, 2007

(87) PCT Pub. No.: WO2005/124063

PCT Pub. Date: Dec. 29, 2005

(65) Prior Publication Data

US 2008/0017229 A1 Jan. 24, 2008

(30) Foreign Application Priority Data

Jun. 17, 2004 (EP) ..... 04253627

(51) Int. Cl.
*E04H 15/20* (2006.01)
*E04G 11/04* (2006.01)

(52) U.S. Cl. ..... 135/137; 135/905; 135/116; 52/2.15; 52/80.1; 52/745.07

(58) Field of Classification Search ..... 135/115–116, 135/905, 87, 96, 137, 124; 52/2.13, 2.15, 52/80.1, 745.06, 745.07, 742.13, 742.14, 52/406.1, 406.2, 407.1, 309.11, 309.14; 264/32–35; 156/79, 156

See application file for complete search history.

(56) References Cited

U.S. PATENT DOCUMENTS

| | | | | |
|---|---|---|---|---|
| 2,270,229 | A | 1/1942 | Neff | |
| 2,913,036 | A * | 11/1959 | Smith | 264/102 |
| 3,292,338 | A | 12/1966 | MacClarence et al. | |
| 3,306,961 | A * | 2/1967 | Spence | 264/82 |
| 3,329,750 | A | 7/1967 | Growald | |
| 3,462,521 | A | 8/1969 | Bini | |
| 3,734,670 | A | 5/1973 | Stickler, Jr. | |
| 3,779,847 | A * | 12/1973 | Turner | 156/156 |
| 3,909,992 | A * | 10/1975 | Stachiw | 52/2.15 |
| 3,999,333 | A * | 12/1976 | Amarantos | 52/2.19 |
| 4,170,093 | A | 10/1979 | Cappellini et al. | |
| 4,324,074 | A * | 4/1982 | South et al. | 52/2.15 |
| 4,446,083 | A | 5/1984 | Nicholls | |
| 4,746,471 | A | 5/1988 | Hale | |
| 5,918,438 | A * | 7/1999 | South | 52/745.07 |
| 6,840,013 | B2 * | 1/2005 | South | 52/2.15 |
| 2003/0116182 | A1 * | 6/2003 | Ueda et al. | 135/124 |

FOREIGN PATENT DOCUMENTS

| | | |
|---|---|---|
| GB | 603655 | 6/1948 |
| GB | 1242647 | 8/1971 |
| GB | 1604944 | 12/1981 |

* cited by examiner

*Primary Examiner*—Winnie Yip
(74) *Attorney, Agent, or Firm*—Brooks Kushman P.C.

(57) ABSTRACT

A prefabricated shell for forming a shelter (14) has a groundsheet (30) and a cover (32) having a gas impermeable inner layer (24) and at least one outer layer. The outer layers are each formed by a layer of cloth that has been impregnated with a water-settable material, e.g. cement. The shell is steeped in water to wet the cement and then the cover is pneumatically inflated to form a space between the cover and the groundsheet. The shelter is then left until the cement has set and is able to support the cover. The shelter can easily be constructed to provide a durable shelter, especially in emergency areas.

20 Claims, 3 Drawing Sheets

PREFABRICATED SHELTER

TECHNICAL FIELD

The present invention relates to prefabricated shelters, particularly shelters that can be erected quickly and easily and that can readily be delivered. The present application finds particular application in providing emergency shelters, e.g. following a natural or man-made disaster.

BACKGROUND ART

Following natural disasters, it is often necessary to provide emergency shelters, for example housing. Such shelters are usually provided by canvas tents but such tents are not particularly sturdy and are inadequate for extreme weather and temperature conditions often encountered at times of emergency. Furthermore, shelter is often required for an extended period of time in such circumstances and canvas tents can wear out before the need for them has been superseded by the building of permanent shelters. Also, canvas tents are unsuitable for some uses, such as field hospitals and stores, since it is difficult to set up hygienic conditions within a canvas tent, militating against their use as a field hospital; also canvas tents are easily accessed, making them easy to loot if valuable stores are held within them.

Large shelters for food and equipment storage are made from large metal frames covered with flexible impermeable material. These are difficult to construct and often require prepared foundations.

It is known to form buildings by inflating a skin pneumatically an pouring concrete over the inflated skin (see U.S. Pat. No. 2,270,229, U.S. Pat. No. 3,734,670, GB-1242647, U.S. Pat. No. 4,746,471, GB-603655) or by applying a layer of liquid concrete onto a skin that can be inflated (see U.S. Pat. No. 3,462,521 and U.S. Pat. No. 4,170,093).

However, such arrangements are time consuming and technically difficult to construct and so are not suitable for use in disaster areas. They will also generally require the deployment of more than one person in order to erect the building and shelter. Also, such shelters often cannot be erected in an emergency area since concrete mixing on a substantial scale requires heavy machinery and power on a scale that is not necessarily available. Also any concrete that has been mixed must be used before it sets, which imposes a timescale for building the shelters that might not be achievable.

U.S. Pat. No. 3,292,338 describes a method of constructing a building by inflating a bag, applying foamed resin blocks to the inside of the bag to form an igloo-like structure that provides the strength of the building, and finally an interior lining is applied. This building requires a substantial amount of work to construct.

U.S. Pat. No. 4,446,083 describes an air-inflated concrete shell suitable for forming the roof of a building. In order to make a roof using this technique, a substantial framework is constructed and an earth support bank is built within the framework. A layer of reinforcing fabric is then spread over the framework to form a covering and it attached to the framework. Dry mortar is then spread over the reinforcing fabric and further alternating layers of fabric and mortar are then applied. Air is pumped under the fabric layers, which inflates the roof in a domed shape. The mortar is then densified by vibrating the perimeter of the shell to work the mortar into the fabric layers and water is sprayed onto the shell and left to set. After setting, the roof is raised, walls are constructed and the roof is then lowered onto the walls. The building of the framework and the earth support bank is time consuming and labour intensive and is completely unsuited for the quick construction of shelters in emergency areas.

DISCLOSURE OF INVENTION

According to the present invention, there is provided an inflatable shell for forming a prefabricated shelter comprising:

- a cover having a gas impermeable inner and an outer formed by at least one layer of cloth that has been impregnated with a water-settable material and/or a radiation settable or air settable material, and
- a groundsheet integral with the cover wherein the inner is pneumatically inflatable to form a space underneath it.

As used herein, the term "inner" and "outer" used in relation to the cover means that the inner is located towards the inside of the shell relative to the outer. The terms "inner" and "outer" do not necessarily mean that the inner forms the innermost layer or section of the cover or the outer forms the outermost layer or section of the cover, although both these arrangements are possible. Each of the inner and outer may be composed of one or more layers.

The pneumatically inflatable space between the ground sheet and the cover can be used to inflate and support the cover. Alternatively, the inner may be pneumatically inflatable by the inclusion of one or more inflatable pockets, e.g. pneumatic struts to raise the cover to provide the required space underneath it.

The water-settable material is preferably cement-based, more preferably quick-drying cement. It can optionally include aggregates, e.g. sand, fibre reinforcements and/or weight-reducing or internally insulating inclusions, for example expended polystyrene beads. Other water-settable material, such as gypsum may be provided instead of cement but cement is preferred for its strength. Also, it is possible to use other settable materials in addition to, or instead of, water-settable materials, e.g. radiation curable or air curable materials, and the use of such materials instead of or in addition to the water-curable material is within the scope of the present invention.

In a preferred embodiment, more than one layer of impregnated cloth is provided and the number of layers will depend on the desired thickness of the set material forming the outside of the shelter. In addition to being impregnated in the cloth, the settable material may be trapped between the inner and the first cloth layer and more settable material may be trapped between the first layer and subsequent layers.

The settable material is preferably adhered to at least one layer of cloth by means of a water-miscible adhesive. Any water-miscible adhesive is appropriate but we prefer PVA (polyvinyl acrylate), which also acts as a plasticiser when using as a water-settable material.

The outer need not extend over the whole of the inner and gaps in the outer can be used to form doorways and/or windows in the shelter. A doorway can be formed after the water-settable material has set by cutting the inner. Either the inner can be totally cut out in the location of the doorway or a single cut may be introduced to provide two flaps that can be closed, for example by studs or a zip fastener. A solid door can be added to the doorway, if required. Also additional openings may be formed for other purposes, e.g. to allow utility pipework or ducting or electric cables into the shelter, or to provide ventilation for fires or heaters.

The inner is preferably transparent or translucent so that, in areas not covered by the impregnated cloth, light can enter into the shelter.

The inner and outer part of the cover may be joined together, e.g. by adhesive and/or studs.

It is preferred that the inner adopts the shape of the fully erected shelter and does not rely solely on the stretching of the material from which the inner is formed to provide the three-dimensional shape of the shelter. In other words, the inner is not inflated like a rubber balloon but rather is filled with gas like a hot-air balloon. In this way, the pressure needed to inflate the cover is not particularly high and can be achieved by a low pressure air pump or foot pump. However, that does not exclude the possibility that the inner may stretch a certain amount. Thus the cover is preferably made to shape.

The volume of the interior of the shelter may be too large to enable the introduction of sufficient air to be achievable within an acceptable time. For this reason, a pump driven by an internal combustion engine is preferred. Alternatively the inflation may be performed with compressed gas from a cylinder or by gas generated by a chemical reaction, e.g. by carbon dioxide given off by the reaction between an acid and a carbonate. A mixture of inflation techniques can be used.

The outer is preferably of a shape that, when the cover has been fully inflated, it has the same shape as the inner but it is advantageous that it is slightly smaller than the inner so that, when the cover has been fully inflated, the cloth is slightly stretched so that it remains taut on the inner when set.

The cloth can be made of any suitable fibre and may be woven or not. It is preferably such that, when a water-settable material is provided, it can wick water to spread the water to the water-settable material. Thus, the cloth may be made of natural or synthetic material and may be hydrophilic or hydrophobic.

If hydrophobic, the wicking action can be achieved by virtue of the space in between the fibres of the cloth providing a capillary action drawing water into the interior of the cloth and hence into contact with the water-settable material.

In one embodiment, at least one fabric layer of the cover is impregnated with the settable material. The impregnated fabric may be a loose non-woven felt, such as a felt that is sometimes called "wadding". The loose non-woven fabric is a compacted assembly of fibres that extend in all directions within a layer, which may be, for example 5-25 mm thick. Cement and other additives may be impregnated into the fabric layer by placing them on the fabric and vibrating the fabric.

According to a further aspect of the present invention, there is provided a package comprising an inflatable shell as discussed above provided within a container, wherein the volume of the container is such that it can hold, in addition to the shell, an amount of water sufficient to set water settable material within the shell. Thus, it is possible to deliver the package containing the shelter shell, add water to the package, which should preferably be added in an amount approximately equal to or slightly greater than the amount of water necessary to completely hydrate the water-settable material. Thus, by way of example, the container may have an internal volume, 60% of which is taken up by the shelter shell, leaving the remaining 40% available for water.

The container should be openable once the water-settable material has been fully wetted. It is preferred that the container can be opened into a flat net, and is preferably at least partly attached to the groundsheet of the shelter to provide additional strength to the groundsheet or it may form part of the groundsheet.

According to a further aspect of the present invention, there is provided a method of erecting a shelter as discussed above, which comprises inflating the inner of the shell to form a space underneath it and allowing the settable material to set. When the settable is water-settable, the method comprises wetting the water-settable material of the outer, inflating the inner of the shell to form a space underneath it and allowing the water-settable material to set.

There will now be described, by way of example only, an embodiment of the present invention with reference to the accompanying drawings in which.

DESCRIPTION OF THE BEST MODE FOR IMPLEMENTING THE INVENTION

Figure 1:
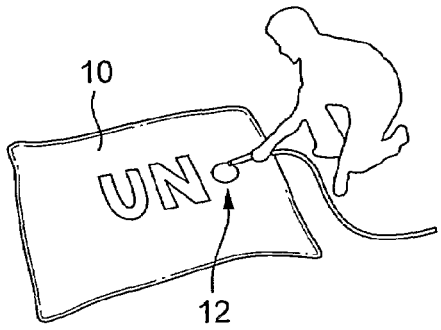
FIG. 1 is a view of a package that can be delivered.

Referring initially to FIG. 1, there is shown a package 10 weighing approximately 230 kg that may be delivered by air to a disaster area. The package includes a container 10 containing the shell of a shelter 14 (see FIGS. 3 and 4); the shell includes cement (see below) and the container also includes a water inlet 12. The volume of the container is sufficient to accommodate, in addition to the shelter 14, an amount of water sufficient to hydrate the cement; this is approximately 40% of the total volume of the container.

Figure 3:
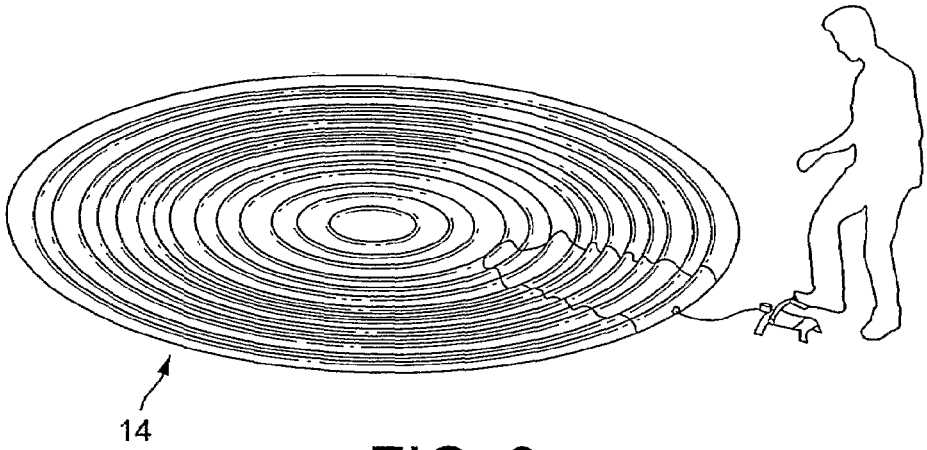
FIG. 3 is a view of the shelter before inflation following wetting.
Figure 2:
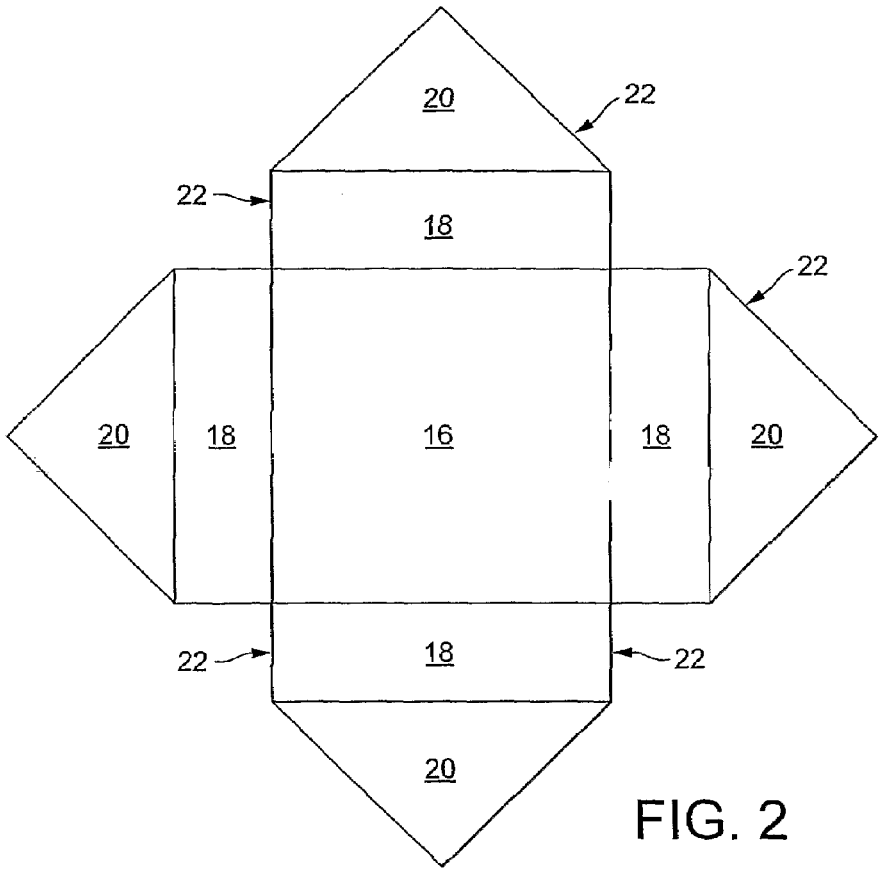
FIG. 2 is a view of the net of the container of the package of FIG. 1, when opened out.
Figure 6:
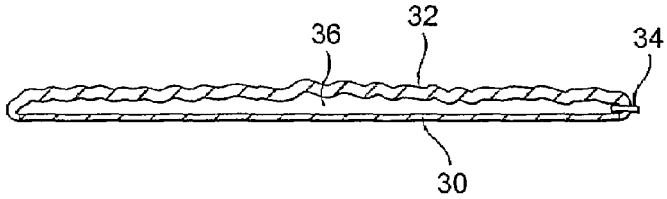
FIG. 6 is a sectional view (not to scale) of the shelter before inflation.

The container is first filled with water and left while the cement outer absorbs the water for a period of ten minutes to one hour, e.g. 15 minutes. The net of the container is shown in FIG. 2 and includes a base 16, four sides 18 and four triangular flaps 20, which fold together to form the top of the container, where the water inlet 12, e.g. a valve or screw top closure, is attached. The container keeps any cement dust enclosed within the container and only exposes the shelter to the elements once the cement has been wetted and hence cannot be blown away in strong winds or be hazardous to those setting up the structure. At the end of the water absorption period, the container is slit along seams 22, which form the diagonals of the container top and also the side edges, thereby reducing the container into the flat web shown in FIG. 2. This releases the shell of the shelter from within the container, which can be unfolded and laid out flat as shown in FIG. 3. This arrangement is shown in section in FIG. 6, from which can be seen that the shelter shell includes a groundsheet 30 and a cover 32 that is joined around the periphery to the groundsheet 30. A valve 34 is also provided to feed air into a space 36 between the groundsheet 30 and the cover 32.

Figure 4:
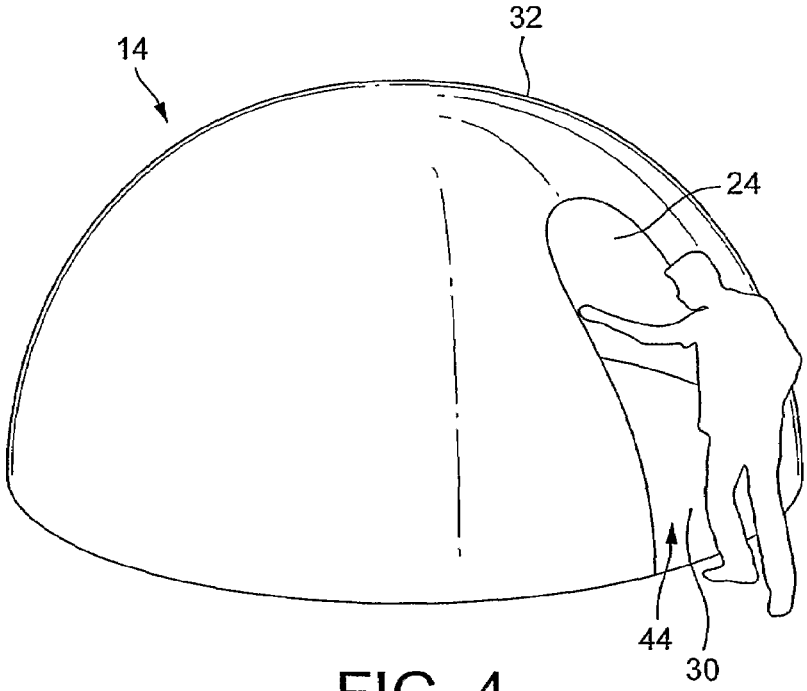
FIG. 4 is a view of the shelter after inflation.
Figure 5:
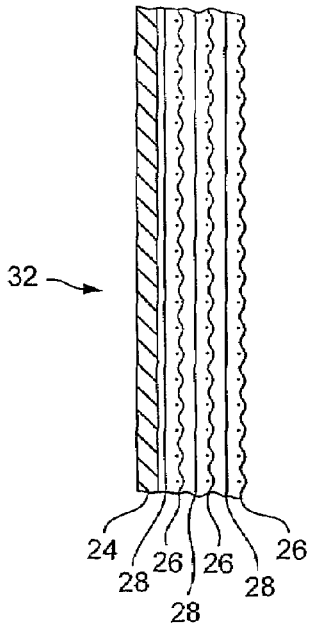
FIG. 5 is a sectional view through the cover of the shelter.

A sectional view through the cover 32 is shown in greater detail in FIG. 5, from which it can be seen that it is made up of an inner layer 24 made of gas impervious material, such as a sheet of polypropylene, polyvinylchloride or polyethylene. Obviously, other materials may be used instead. It is not necessary for the inner layer 24 to be totally impervious to gas and it can be made of a material that will allow a small amount of gas through it, for example a very tightly woven canvas that is optionally treated to make it impervious. The inner layer 24 is tailored to have the shape of the final dome (see FIG. 4) but obviously lies flat in the folded-out form shown in FIG. 3. It may be made in one piece, e.g. by moulding, or in several pieces that are joined together. Outside the inner layer 24 there are successive layers made up of a fabric 26 and cement 28. This arrangement holds the cement to the fabric and prevents loss of cement and dusting. The cement is adhered to the fabric by PVA glue to prevent it from escaping through the fabric and to prevent it moving within the space between any layer of fabric 26 and the adjacent layer of fabric. The amount of PVA glue used in the structure is approximately 2 to 3% of the weight of the cement. The cement layer 28 may include aggregates such as sand and/or filler materials, for example expanded polystyrene, which may be useful in reducing the weight of the shelter and providing thermal insulation.

The fabric 26 may be woven or non-woven and made of natural or synthetic materials. The fabric preferably wicks water added to the container 10 so that it quickly pervades through the cover 32 and wets all the cement layers 28. Although three layers of fabric/cement are shown in FIG. 5, any number of layers may be provided in order to give the thickness of walls in the shelter, e.g. up to 10-15 mm thick. Instead of alternating layers of fabric and cement, cement-impregnated felt, e.g. wadding, may be used; the impregnation may be achieved by vibrating the fabric.

Figure 7:
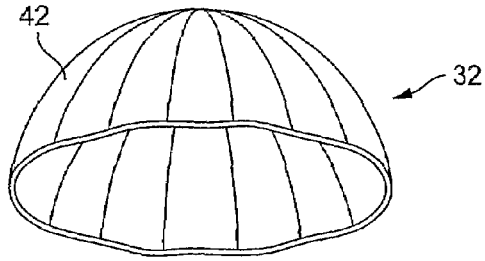
FIG. 7 is a perspective view showing one possible construction of the layers of the cover.

The fabric layers 26 in the cover 32 may be made from a series of segment-shaped strips 42 that have been joined together (see FIG. 7). Alternatively, the cover 32 may be made by three-dimensional weaving. Although shaped panels account for much of the shape of the final shelter, the cover may also stretch to a certain extent to provide the desired internal shape of the shelter.

After the cover 32 has been inflated, the cement in the shelter is left to set fully. In order to prevent it drying out, it is preferred to inflate the cover in the evening and allow it to set overnight. The amount of cement should obviously be such as to form a self-supporting roof, when set.

Once the cement has set, a doorway may be cut. The doorway is shown in FIG. 4 by the reference number 44. In the region 44, no fabric and cement layers 26, 28 are applied and accordingly the door may be cut merely by cutting through the inner 24. Likewise, gaps in the cover may be left for windows, pipes and ducts (not shown); the windows may be cut out or may be left with the inner in place. For this reason, the inner is preferably transparent.

Referring again to FIG. 6, the material of the inner 24 is not necessarily made of the same material as the material of the groundsheet 30 and the groundsheet 30 is preferably chosen for its wear-resistance; a preferred material is woven polyethylene. However, a protective cover may be placed on the groundsheet 30 inside the shelter to prevent it being damaged in use. The cover 32 is fixed to the groundsheet around its periphery by any suitable means, for example heat welding, adhesive etc.

The groundsheet 30 may be secured to the ground via stakes and eyelets may be provided in the groundsheet for this purpose.

By cutting the doorway 44, the pressure within the cover is released. The set cement, acting in compression, will support the cover. The strength of the cement will be substantially improved by the presence of the fabric, whose fibres reinforce the cement. The use of PVA to adhere the cement 28 to the fabric 26 acts as a plasticiser for the cement, thereby improving its properties.

One advantage of using a gas impermeable inner 24 is that it will generally also be waterproof, thereby preventing rain from penetrating into the enclosure.

Furthermore, it can possibly be sterilised for use in sterile environments, for example in field hospitals.

After having cut a slit in the inner to allow passage through the doorway, the inner material at the doorway 44 may be retained or may be removed. If retained, the inner may be refastened e.g. by a zip fastener to form a door or alternatively a separate door made of local materials (not shown) may be provided. In one embodiment, the container and the shell are delivered on a pallet that is configured so that it can form a door. One or more further layer or layers may be applied on top of the cover after the cement has set to provide thermal insulation; in addition, the cover may be painted.

Once deployed, the structure may be loaded with heavy additional material which might be: concrete, earth, sandbags or snow, since the structure will be strengthened by distributed compressive loads.

The enclosure can be scaled to any required diameter. It may be a dome shape (as shown in FIG. 4) or may be elongated and have a curved (part cylindrical) roof. In one embodiment, a series of dome-shaped enclosures may be connected together with corridors made of elongated enclosures with curved roofs.

As can be seen, the enclosure of the present invention provides a lightweight package 10 that can be delivered by air to an emergency area and formed quickly into a useful structure using locally-provided water. The water need not be potable. The shelter can be erected with low labour input and the shelter can have a life span of many years. By way of example, a package 10 for an enclosure 4 m in diameter can be made weighing approximately 230 kg.

Figure 8:
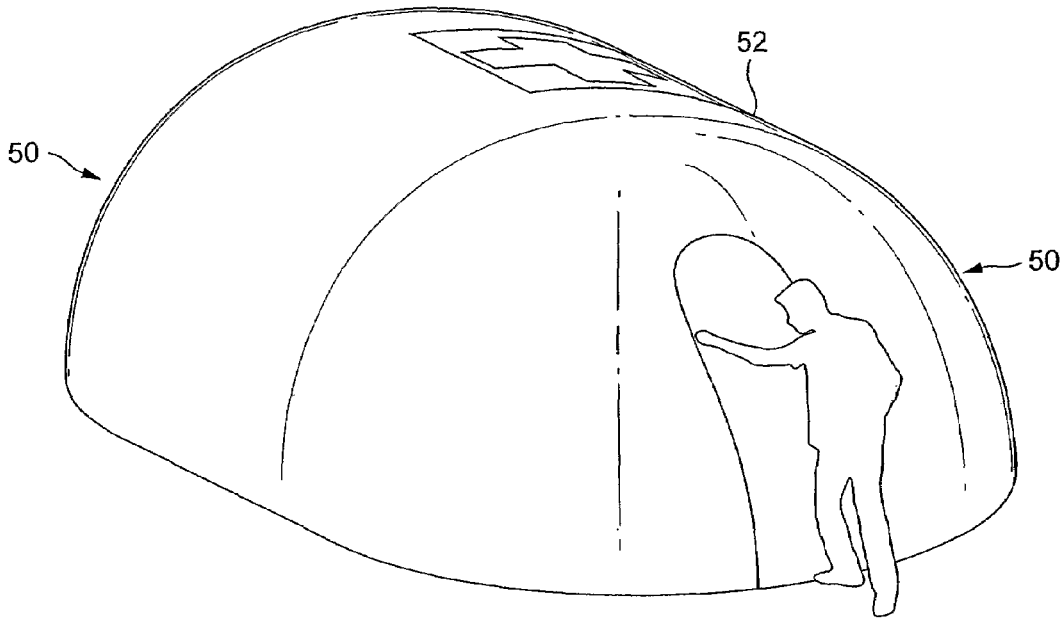
FIG. 8 is a view of an alternative design of shelter after inflation.
Figure 9:
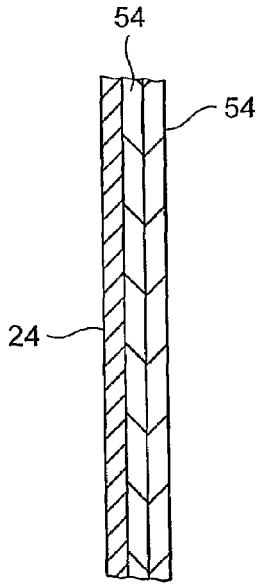
FIG. 9 is a sectional view through the cover of the shelter of FIG. 8.

FIG. 8 shows and alternative design of a shelter that is similar to the shelter of FIG. 4 but has an elongate shape; the cover has rounded end sections 50, which are made as described in connection with FIGS. 4-7, whereas the outer layer(s) in the central section 52 are made up from rectangular pieces of fabric, preferably impregnated wadding. The walls of the shelter are similar in construction to FIG. 5 but instead of having alternating layers of fabric and cement, they have two layers of cement impregnated polypropylene felt 54, in addition to the gas impermeable layer 24.

The invention claimed is:

1. An inflatable shell for forming a prefabricated shelter comprising:

a cover having a inner layer which is gas impermeable and an outer layer formed by at least one layer of cloth that has been impregnated with a settable material, the settable material being accessible to a setting medium from the outside of the shell, and a groundsheet integral with the cover, wherein the inner layer of the cover and the groundsheet form a pneumatically inflatable space therebetween, when inflated during an inflation time period.

2. A shell as claimed in claim 1, wherein the settable material is cement-based.

3. A shell as claimed in claim 1, wherein the at least one layer of cloth that has been impregnated with the settable material comprises at least two layers of cloth and the settable material is trapped between adjacent layers of cloth.

4. A shell as claimed in claim 1, wherein the at least one layer of cloth comprises at least one layer of a felt impregnated with the settable material.

5. A shell as claimed in claim 1, wherein the settable material is adhered to the at least one layer of cloth with an adhesive.

6. The shell as claimed in claim 5, wherein the adhesive is a water-miscible adhesive.

7. The shell as claimed in claim 6, wherein the water-miscible adhesive comprises polyvinyl acrylate.

8. A shell as claimed claim 1, wherein part of the inner layer is not covered by the said at least one layer of cloth, whereby it can form at least one of a doorway and a window.

9. A shell as claimed in claim 1, wherein the inner layer is transparent or translucent.

10. A shell as claimed in claim 1, wherein the inner layer is waterproof.

11. The shell as claimed in claim 1, wherein the settable material is a water-settable material and the cloth is capable of wicking water to spread water to the water-settable material.

12. The shell as claimed in claim 1, wherein the settable material is selected from a group consisting of a water-settable material, a radiation-settable material, an air-settable material, and combinations thereof, the settable material being reacted to form a reacting setting material during a time period beginning prior to the end of the inflation period when the shell is inflated.

13. A package comprising a container and a shell as claimed in claim 12 within the container, wherein the volume of the container is such that it can hold, in addition to the shell, an amount of water sufficient to set the water-settable material.

14. A method of erecting a shelter as claimed claim 12 which comprises wetting the water-settable material of the outer layer; inflating the inner layer to form a space underneath the inner; and allowing the water-settable material to set.

15. A method of erecting a shelter as claimed in claim 1, which comprises inflating the inner layer to form a space underneath the inner layer and allowing the settable material to set.

16. An inflatable shell for forming a prefabricated shelter having an interior and an exterior and being disposed on a surface, the shell comprising:

an inner layer connectable to the surface and defining a cavity during a first inflation time period when the inner layer is self-supportingly inflated; and an outer layer disposed toward the exterior of the shelter relative to the inner layer and covering at least a portion of the inner layer, the outer layer comprising a cloth comprising fibers, and an impregnated settable material disposed between the fibers, wherein the settable material, when reacting with a setting medium, begins setting during a setting time period beginning prior to the end of the inflation time period.

17. The inflatable shell of claim 16, wherein the setting medium is selected from a group consisting of water, radiation, and air.

18. The inflatable shell of claim 16, wherein the impregnated settable material comprises a cement material.

19. The method of use of an inflatable shell for forming a prefabricated shelter having an exterior and an interior, the shelter being disposed on a surface, the method comprising the steps of:

(a) providing an inner layer capable of being inflated to form a cavity, the inner layer being disposed on the surface;

(b) applying a settable coating to an outer layer, the outer layer being disposed on the exterior of the shelter and being connected to the inner layer;

(c) reacting a setting medium with the settable coating to form a reacting settable coating during a setting time period;

(d) inflating the inner layer to form a cavity during an inflation time period, the setting time period having not concluded by the time that the inflation time period concludes; and (e) concluding the setting time period such that the outer layer comprises a self-supporting prefabricated shelter.

20. The method of claim 19, further comprising the steps of (f) forming the outer layer into a reaction container having a reaction cavity for use with step (c); and (g) opening the reaction cavity such that the reaction container is essentially planar and is adjacent to the inner layer when the reacting settable coating is present during the setting time period, and before step (d), the reacting settable coating conforming to a portion of the inner layer when the inner layer is inflated during step (d).

* * * * *